US007909424B2

(12) United States Patent
Giri et al.

(10) Patent No.: US 7,909,424 B2
(45) Date of Patent: Mar. 22, 2011

(54) METHOD AND SYSTEM FOR DISPENSING LIQUID

(75) Inventors: Manish Giri, Corvallis, OR (US); Joshua M. Yu, Corvallis, OR (US); Chris H. Bakker, Corvallis, OR (US); Kevin F. Peters, Corvallis, OR (US); Vincent Remcho, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 865 days.

(21) Appl. No.: 11/888,401

(22) Filed: Jul. 31, 2007

(65) Prior Publication Data

US 2009/0033692 A1 Feb. 5, 2009

(51) Int. Cl.
*B41J 29/393* (2006.01)
*B41J 29/38* (2006.01)
*B41J 2/05* (2006.01)

(52) U.S. Cl. ..... 347/19; 347/5; 347/6; 347/7; 347/9; 347/14; 347/15; 347/20; 347/54; 347/55; 347/56; 347/57; 347/58; 347/59; 347/61; 347/63; 347/66; 73/290 R; 73/293

(58) Field of Classification Search ..... 347/6, 15, 347/19, 56, 57, 61, 66; 73/293
See application file for complete search history.

(56) References Cited

U.S. PATENT DOCUMENTS 5,880,748 A * 3/1999 Childers et al. ..... 347/6
6,284,113 B1 9/2001 Bjornson et al.
6,312,075 B1 * 11/2001 Walker ..... 347/7
6,354,689 B1 * 3/2002 Couwenhoven et al. ..... 347/19
6,431,673 B1 * 8/2002 Heim et al. ..... 347/9
6,431,679 B1 * 8/2002 Li et al. ..... 347/19
6,592,825 B2 7/2003 Pelc et al.
6,594,406 B1 * 7/2003 Hecht ..... 382/306
6,740,530 B1 5/2004 Bruce et al.
6,847,465 B1 * 1/2005 Wetchler et al. ..... 358/1.13
6,848,181 B1 2/2005 Silverbrook
6,855,925 B2 * 2/2005 Ellson et al. ..... 250/288
7,135,146 B2 11/2006 Johnson et al.
2002/0030713 A1 * 3/2002 Silverbrook ..... 347/19
2003/0179256 A1 * 9/2003 Endo ..... 347/19
2005/0083364 A1 * 4/2005 Billow ..... 347/19
2005/0112029 A1 5/2005 Webb
2005/0231560 A1 10/2005 Silverbrook
2006/0165559 A1 7/2006 Greenstein et al.
2006/0250431 A1 * 11/2006 Hoshiyama et al. ..... 347/14
2006/0284916 A1 * 12/2006 Heiles et al. ..... 347/19
2007/0014694 A1 1/2007 Beard et al.
2008/0259107 A1 * 10/2008 Farr et al. ..... 347/14
2008/0261326 A1 * 10/2008 Dudenhoefer et al. ..... 436/174

* cited by examiner

*Primary Examiner* — Ryan Lepisto

(57) ABSTRACT

A method and an apparatus for dispensing liquid are disclosed. The method includes the steps of storing one or more liquids in a thermal inkjet print head and providing a well plate having at least one well. At least one of the liquids is dispensed from the thermal inkjet print head into at least one well. The volume of the dispensed liquid is a fraction of the total required volume of the liquid in the at least one well, and the dispensing step is performed multiple times to dispense the required volume of the at least one liquid in at least one well.

17 Claims, 16 Drawing Sheets

METHOD AND SYSTEM FOR DISPENSING LIQUID

BACKGROUND

The abundance of therapeutic targets of drug candidates and of combinatorial and computational technologies has created a demand for laboratory automation of mix-and-measure assays (chemical reaction tests). To increase laboratory productivity and reduce costs, a clear trend towards assay miniaturization, parallelization, and higher throughput has emerged. Traditional approaches to low-volume liquid handling technologies range from classical liquid handlers employing syringe-based dispensing to piezo-electric dispensers. Some offer a fixed volume at the expense of accuracy and precision while others promote a variable volume range at the expense of delivery or dead volume. Most of the pressure syringe-based systems as well as solenoid valve mechanism based systems are not well suited to dispense liquids in nano- to low-micro-liters volume range with great precision, as is required for assay miniaturization demanded by high throughput screening. These traditional dispenser technologies generally comprise an assembly of discrete components, including one nozzle per assembly. Dispensing from a single nozzle can be slow. To compensate partly for the slow throughput performance these single-nozzle dispensers can be multiplexed by adding one or more additional assemblies of discrete components.

An inkjet printer typically includes one or more cartridges that contain ink. In some designs, the cartridge has discrete reservoirs of more than one color of ink. Each reservoir is connected via a conduit to a print head that is mounted to the body of the cartridge. The print head is controlled for ejecting minute drops of ink from the print head to a printing medium, such as a paper which is advanced through the printer. The print head is usually scanned across the width of the paper. The paper is advanced, between print head scans, in a direction parallel to the length of the paper.

The mechanism for expelling ink drops from each ink chamber (known as a "drop generator") includes a heat transducer, which typically includes a thin-film resistor. The resistor is carried on an insulated substrate, such as a silicon die. The resistor has conductive traces attached to it so that the resistor can be selectively driven (heated) with pulses of electrical current. The heat from the resistor is sufficient to form a vapor bubble in each ink chamber. The rapid expansion of the bubble propels an ink drop through the nozzle that is adjacent to the ink chamber.

BRIEF DESCRIPTION OF THE DRAWINGS

The drawings referenced herein form a part of the specification. Features shown in the drawings are meant as illustrative of exemplary embodiments of the invention.

DETAILED DESCRIPTION OF THE DRAWINGS

In the following detailed description of exemplary embodiments of the invention, reference is made to the accompanying drawings that form a part hereof, and in which is shown by way of illustration exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined by the appended claims.

Figure 1:
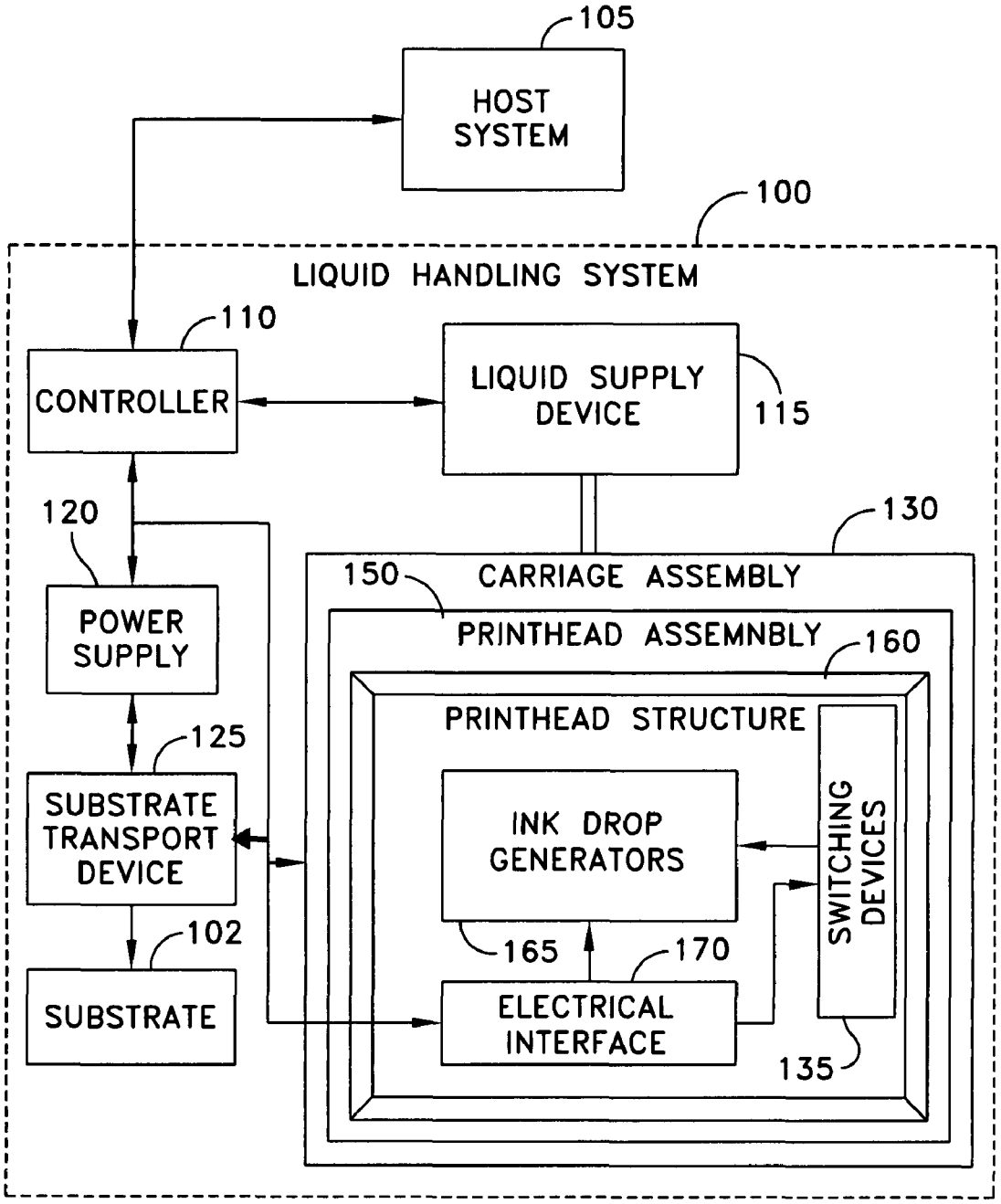
FIG. 1 is a block diagram of an exemplary embodiment of an overall automated liquid handling system incorporating the present invention.

FIG. 1 is a block diagram of an overall liquid handling system 100, according to an embodiment of the present invention. In an exemplary embodiment, liquid handling system 100 is based on an eight (8) color thermal inkjet printer, available as HP Photosmart Pro B9180, from Hewlett Packard, Inc. Liquid handling system 100 can be used for dispensing a liquid on a substrate, for example, on a well plate 102. Liquid handling system 100 is coupled to a host system 105 (such as a computer or microprocessor) for inputting dispensing parameters such as amount of liquid to be dispensed, number of liquids to be dispensed, and a location on a well plate on which the liquid(s) are to be dispensed. A graphic user interface (see, for example, of FIG. 9) allows a user to dispense desired volumes up to eight (8) different liquids in different mix ratios of volumes ranging from picoliters (pL) to several microliters (μL) for reach liquid. Liquid handling system 100 includes a controller 110, a power supply 120, a substrate transport device 125, a carriage assembly 130 and a plurality of switching devices 135. The liquid supply device 115 is in fluidic communication with a print head assembly 150 for selectively providing liquids to the print head assembly 150. The substrate transport device 125 provides a means to move a substrate 102 (such as a well plate) relative to the liquid handling system 100. Similarly, the carriage assembly 130 supports the print head assembly 150 and provides a means to move the print head assembly 150 to a specific location over the substrate 102 as instructed by the controller 110. The carriage assembly 130 has been raised to accommodate different well plates or other user specified substrates. The height of carriage assembly 130 with respect to substrate transport device 125 may be adjustable to accommodate substrates of different thicknesses.

The print head assembly 150 includes a print head structure 160. The print head structure 160 contains a plurality of various layers including a substrate (510 of FIG. 5). The substrate may be a single monolithic substrate that is made of any suitable material (preferably having a low coefficient of thermal expansion), such as, for example, silicon. The print head structure 160 also includes a high-density arrangement of ink drop generators 165 formed in the print head structure 160 that contains a plurality of elements for causing an ink drop to be ejected from the print head assembly 150. The print head structure 160 also includes an electrical interface 170 that provides energy to the switching devices 135 that in turn provide power to the high-density arrangement of ink drop generators 165.

During operation of the liquid handling system 100, the power supply 120 provides a controlled voltage to the controller 110, the substrate transport device 125, the carriage assembly 130 and the print head assembly 150. In addition, the controller 10 receives the dispensing data from the host system 105 and processes the dispensing data into system control information. The dispensing data and other static and dynamically generated data are provided to the substrate transport device 125, the carriage assembly 130 and the print head assembly 150 for efficiently controlling the liquid handling system 100.

Figure 2:
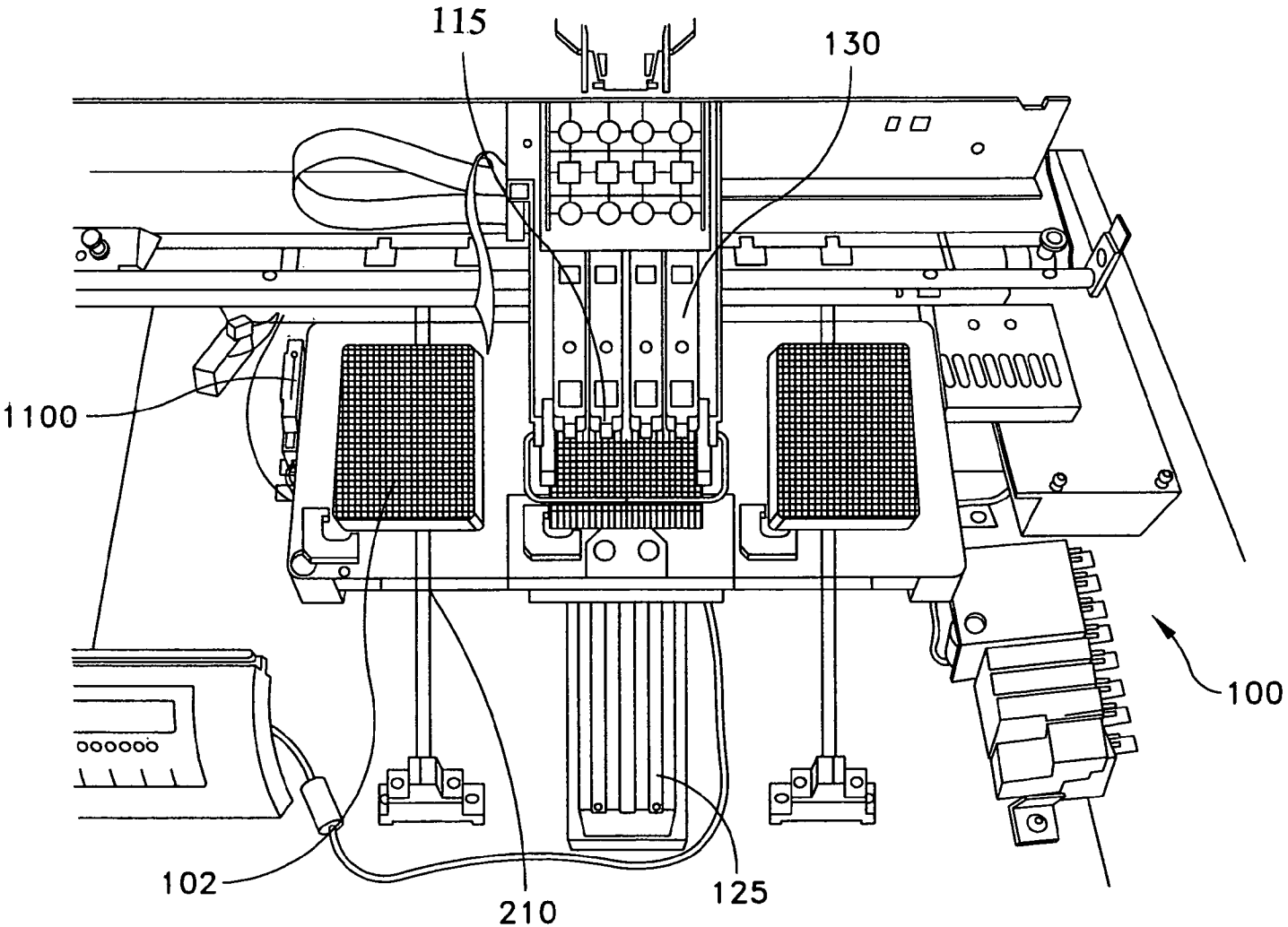
FIG. 2 illustrates an automated liquid handling system according to an embodiment of the invention.

FIG. 2 illustrates an exemplary embodiment of an automated liquid handling system 100. System 100 includes a substrate transport device 125, a carriage assembly 130, a liquid supply device or a pen 115, and a carrier board 210. Carrier board 210 carries multiple substrate or well plates 102. Each pen 115 may accommodate up to two (2) different fluids. Liquids, such as reagents, may be stored in pens 115, used as needed and then frozen for later use. Pens 115, therefore, also act as potential storage device for liquids and thus reduce waste of precious liquids which may result from the transfer from a separate storage device. In an exemplary embodiment of the present invention, pens 115 may store the fluids in amounts ranging from ten (10) milliliters (mL) to twenty (20) mL. Smaller stored volumes may be possible, down to less than two (2) mL. Liquid handling system 100 may be encased in an environmental chamber (not shown) to avoid environmental contamination as well as to ensure user safety. An electrostatic drop detect system 1100 is also included to test print head 150 (of FIG. 1) of pens 115.

Figure 3A:
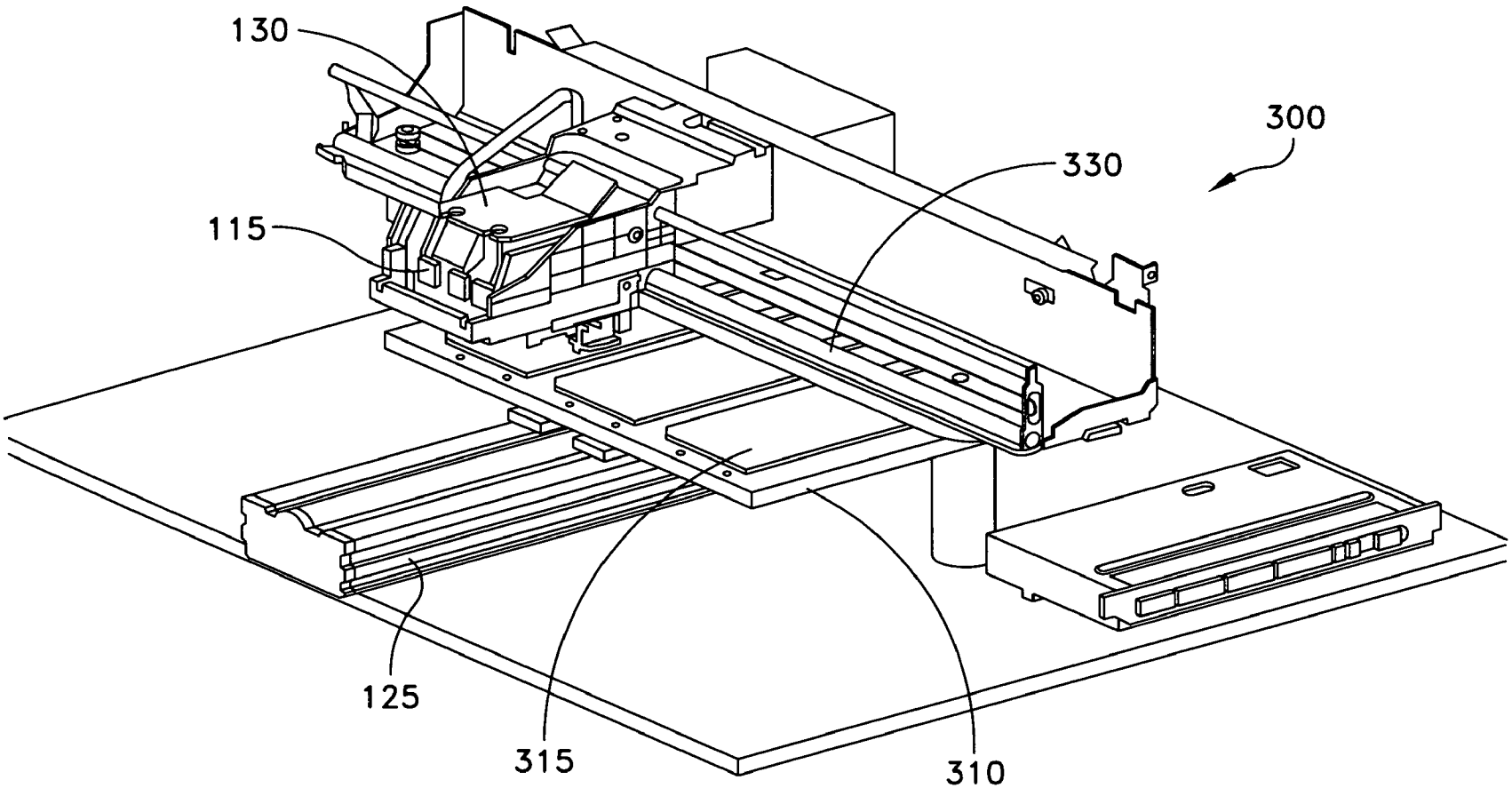
FIG. 3A illustrates a perspective view of a modified carriage stand capable of printing on substrates with thickness greater than one (1) centimeter (cm), according to an embodiment of the invention.

FIG. 3A illustrates a perspective view of a carriage stand 300 according to an embodiment of the invention. A substrate transport device 125 carries a carrier board 310. In an exemplary embodiment, carrier board 310 is constructed with grooves to hold different types of well plates, glass slides and other substrates, for example, nitrocellulose membranes, agar gels, etc. Carrier board 310 carries a well plate 315. In an exemplary embodiment, carrier board 310 can accommodate up to nine (9) well plates 315. Carrier board 310 may accommodate substrates having a thickness of one (1) centimeter (cm) or more. A carriage assembly 130 holds inkjet pen 115. In an exemplary embodiment, carriage assembly 130 holds up to four (4) inkjet pens 115. Each inkjet pen 115 may contain one (1) or two (2) different fluids. Accordingly, up to eight (8) fluids may be dispensed through four (4) inkjet pens 115 contained by carriage assembly 130. These exemplary embodiments are non-limiting as different numbers of pens, fluids, plates, and configurations are certainly possible. Carriage assembly 130 travels on a rail 330 which is positioned transversely to carrier board 310, thus the print heads of pens 115 scan across the width of carrier board 320. Carrier board 310 is advanced, between print head scans, in a direction parallel to the length of carrier board 310. Print heads of pens 115 fill well plates 315 in a scanning mode.

Figure 3B:
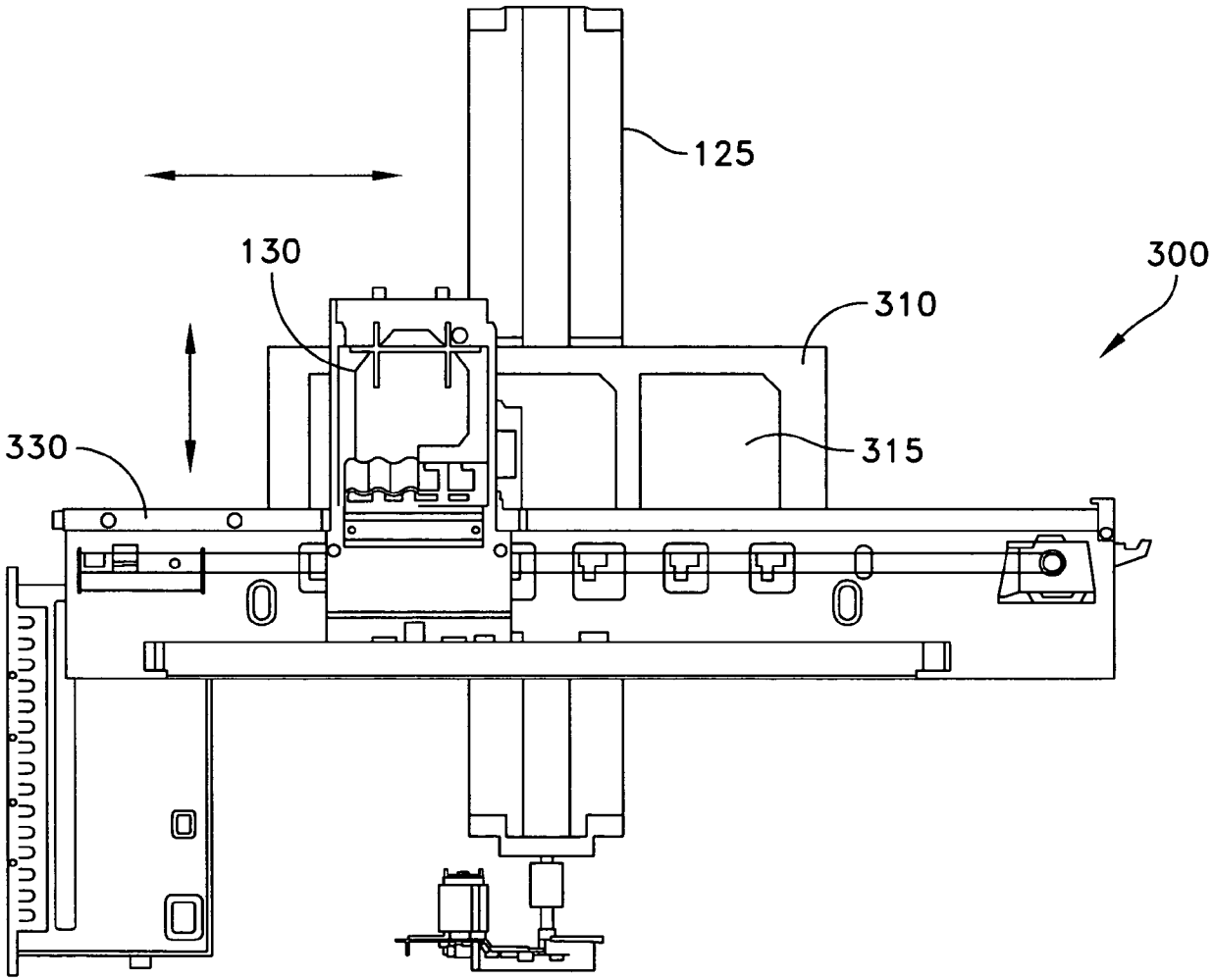
FIG. 3B illustrates a plan view of the modified carriage stand of FIG. 3A, according to an embodiment of the invention.

FIG. 3B illustrates a plan view of an exemplary embodiment of a carriage stand 300. Carrier board 310 travels along substrate transport device 125 longitudinally. Carriage assembly 130 travels transversely to carrier board 310.

Figure 4:
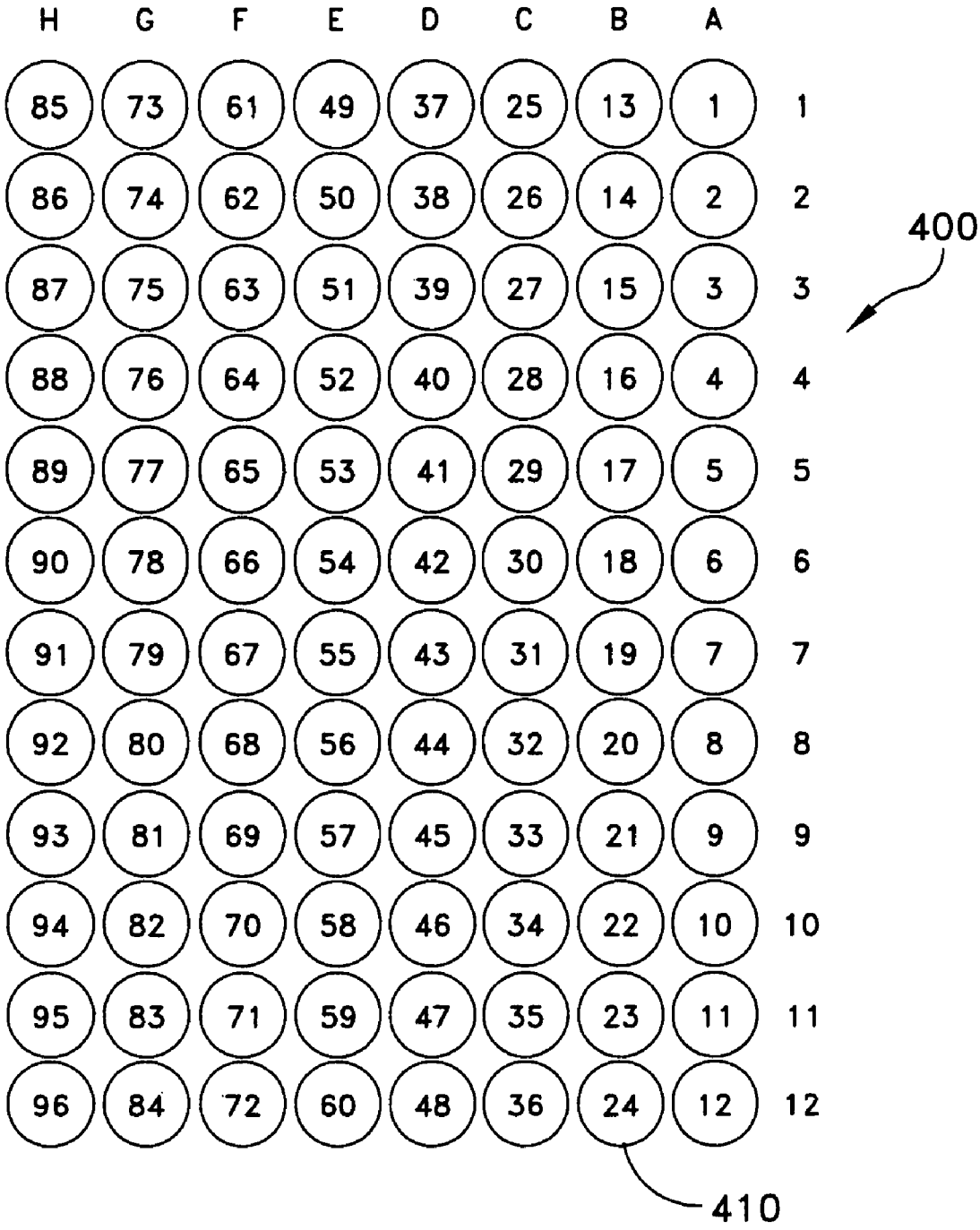
FIG. 4 illustrates an exemplary well-plate which can be filled using the automated liquid handling system of FIG. 2.

FIG. 4 illustrates an exemplary well plate 400 suitable for use with system 100. Well plate 400 has a plurality of wells 410. An exemplary well plate 400 may have ninety-six (96) wells 410. Such well plates are known in the art and are available, for example, from Corning Incorporated Life Sciences, Lowell, Mass. Well 410 may accommodate volumes between 190 microliters (μL) to 2000 μL, for example. Other well plates may have different sized wells and different numbers of well compartments. Well 410 may or may not be indented on a substrate and includes any area upon which a liquid is to be dispensed. Common well plates are formatted according to standards, including for example 384 wells, 1536 wells, 2080 wells, 3456 wells, and so on. Plates having more wells also typically have a smaller well size and well volume, down to approximately 1 uL and smaller. It is to be understood that embodiments of the present invention are compatible with the smallest wells by dispensing in the nano- to low-micro-liter volume range.

Figure 5:
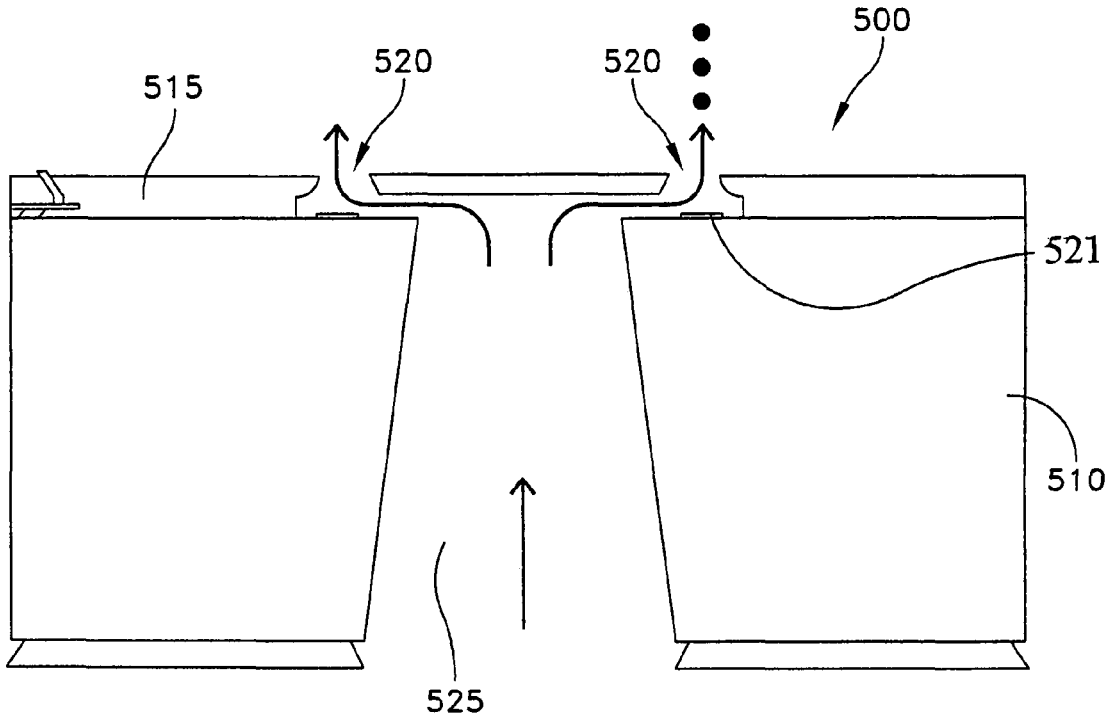
FIG. 5 illustrates a cross-sectional view of a micro machined silicon die which may be used for dispensing liquid into a well-plate of FIG. 4.

FIG. 5 illustrates a micro machined silicon die 500 through which liquid is dispensed into, for example, a well 410 (FIG. 4). A slot 525 is machined in a silicon substrate 510. In another embodiment of the present invention, substrate 510 may be glass or other insulating material preferably with a low coefficient of thermal expansion. By way of non-limiting example only, the slot may have a narrow opening ranging from about 0.05 millimeter (mm) to 0.5 mm. In an exemplary embodiment, substrate 510 may have a thickness ranging from about 300 micrometers (μm) to 2000 μm. A polymer layer 515 is deposited over substrate 510. Polymer layer 515 may have thickness ranging from about 10 μm to about 60 μm. In an exemplary embodiment, two apertures 520 are formed in polymer layer 515. Apertures 520 act as nozzles through which liquid is dispensed. In an exemplary embodiment of the present invention, apertures 520 have diameters ranging from about 5 μm to about 100 μm. Two resistors 521 are provided for two apertures 520. Resistors 521 provide heat to form bubbles of the liquids and to expel the liquid bubbles out of apertures 520. In an exemplary embodiment of the invention, a substrate 510 may have one hundred (100) to two thousand (2000) apertures. Liquid to be dispensed travels through slot 525 and is dispensed through apertures 520 as is known in the art. Drops of liquids in size ranging from about 5 picoliter (pL) to 200 pL may be fired from a nozzle 520 at a frequency ranging from 1 kilohertz (kHz) to 20 kHz. Since the actuation mechanism is built in close proximity to nozzles 520, there is no requirement for a large fluid head for reproducible ejection, and the liquid waste is reduced down to nanoliters (nL).

Figure 6A:
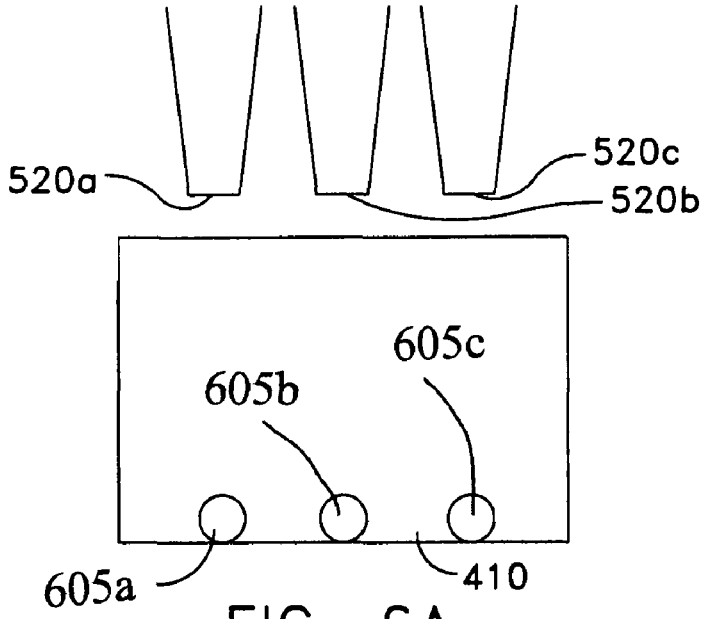
FIG. 6A illustrates schematically multiple nozzles localized on a single well, according to an embodiment of the present invention.

FIG. 6A illustrates a schematic side view of a well 410. A typical thermal inkjet print head (not shown) is designed at 1200 dots per inch (dpi) in the paper axis. A typical well 410 may have an opening of about 2 millimeter (mm). Thus, up to 100 nozzles may be localized on well 410 at any given instant. The swath height of the typical inkjet print head 160 (of FIG. 6B) is about one (1) inch. Thus, the entire swath of the print head covers about six (6) wells of about 2 mm diameter at any given instant. Accordingly, a plurality of nozzles may be localized on a single well 410, as well as a plurality of nozzles may be localized on a plurality of wells 410. Controller 110 (of FIG. 1) contains computer code which uses a digital "half-toning" writing systems routine to create dispersion of drops in individual wells 410. Three nozzles 520*a*, 520*b*, and 520*c* are localized on well 410. Drops 605*a*, 605*b*, and 605*c* are dispensed by nozzles 520*a*, 520*b*, and 520*c* respectively into well 410. Drops 605*a*, 605*b*, and 605*c* may have diameters ranging from about 10 μm to 100 μm. The volume of liquid dispensed in a single drop is typically a fraction of the total desired volume. Hence, the dispensing step is repeated multiple times until the desired volume of a given liquid is dispensed. For each type of liquid, a look up table contains the drop volume and firing parameters. Each layer of drops will have approximately the same thickness as that of the drop diameter. The diffusion distance for individual molecules of drops 520*a*, 520*b*, and 520*c* is relatively small when compared to a drop having a diameter of 1 mm such as may be dispensed by conventional single-nozzle technologies. Here, instead, the mixing of individual molecules from within drops 520*a*, 520*b*, and 520*c* is greatly enhanced by the drops having small size, being dispensed with some finite velocity, and being dispensed as layers. If more than one liquid is to be dispensed, each liquid may be alternately dispensed in well 410, which facilitates rapid mixing of different liquids. Multiple layers of multiple liquids may therefore be alternately dispensed in well 410.

Figure 6B:
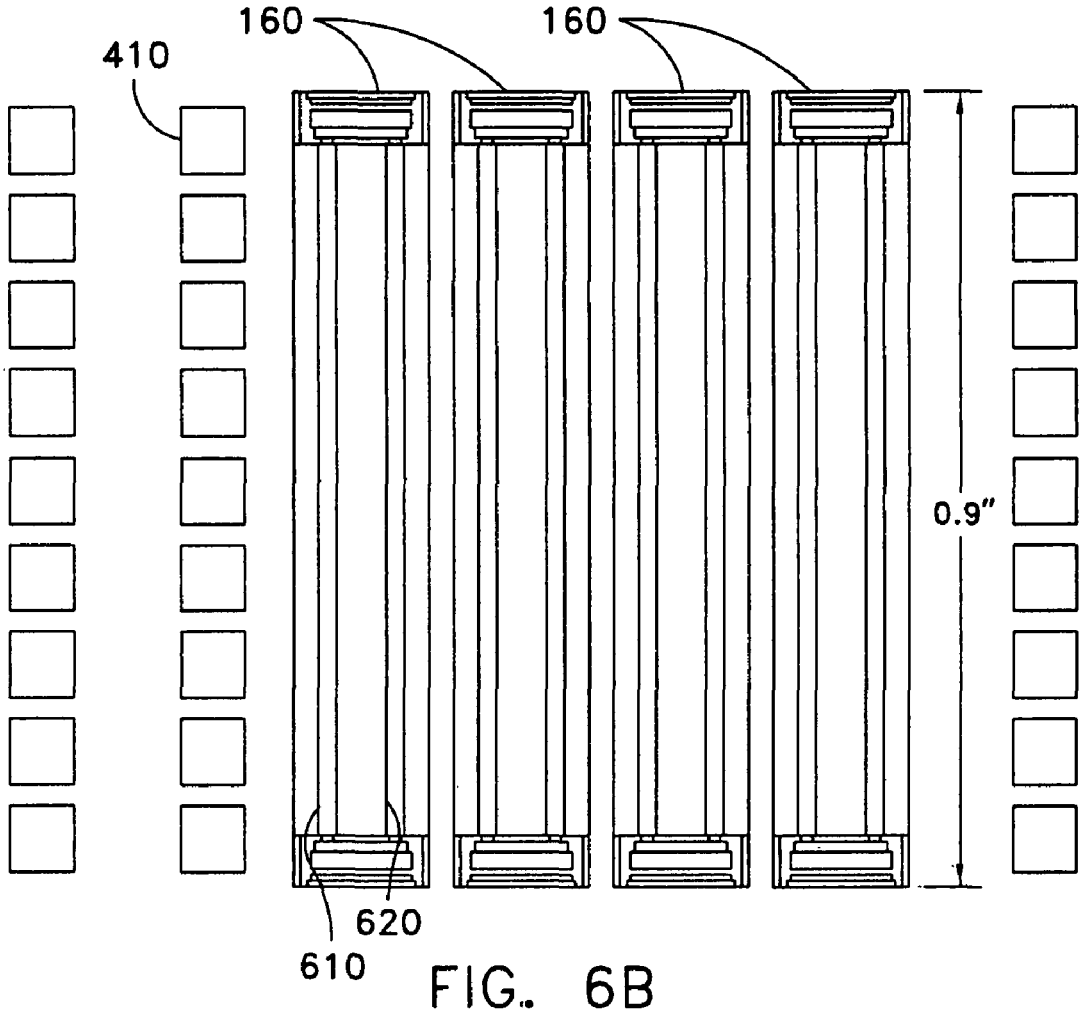
FIG. 6B illustrates a print head with multiple channels spanning across multiple wells according to an embodiment of the present invention.

FIG. 6B illustrates four print heads 160 spanning over multiple rows and multiple columns of wells 410. Each print head 160 has two channels 610 and 620, each of which can dispense a distinct liquid.

Figure 7A:
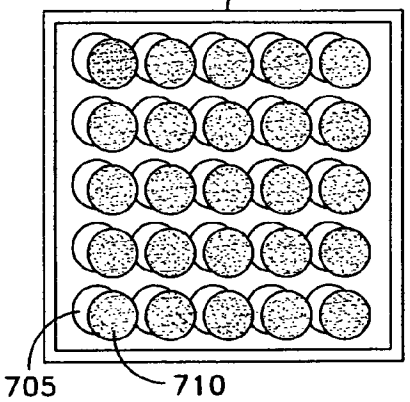
FIGS. 7A-7D illustrate a top view and a side view of a well wherein three different liquids have been dispensed and the resultant mixing process, according to an embodiment of the present invention.
Figure 7B:
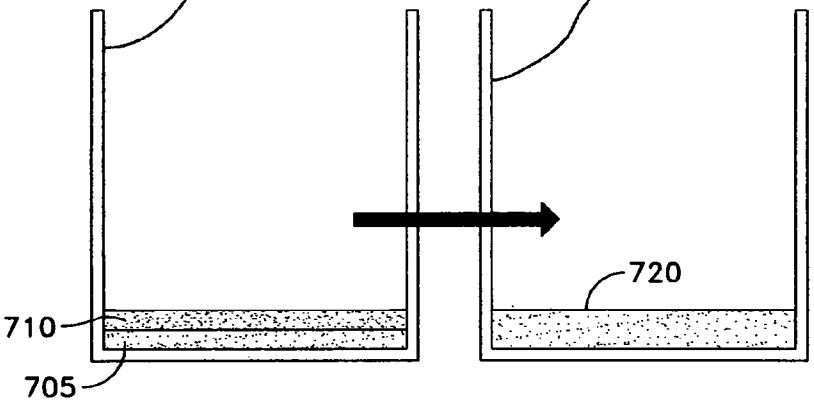
Figure 7C:
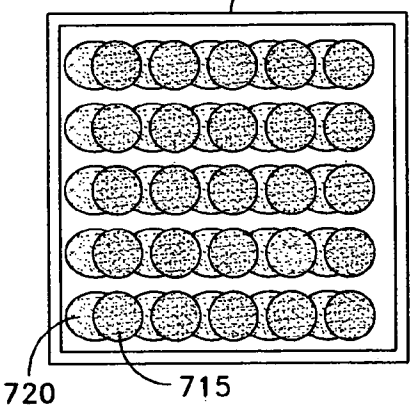
Figure 7D:
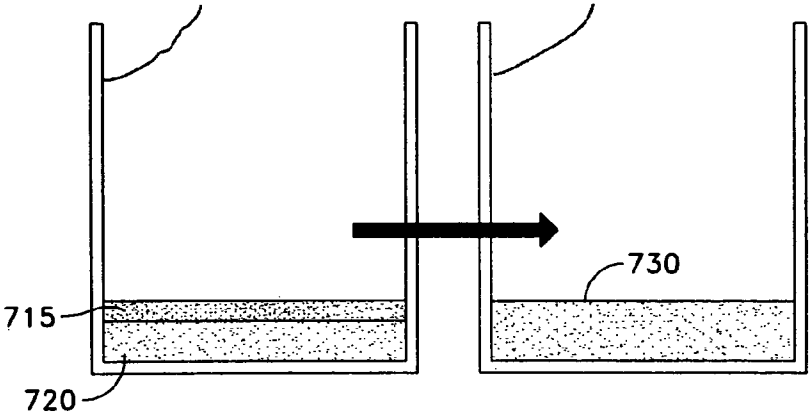

Referring now to FIG. 7A, a top view of well 410 is illustrated. Dispensing and mixing of three different fluids is described only by way of a non-limiting example. In a first stage of dispensing, two different fluids 705 and 710 are dispensed sequentially in well 410. Nozzles 520*a* and 520*b* (of FIG. 6) may be positioned such that each following nozzle is slightly offset from the firing position of the previous nozzle. FIG. 7B illustrates a side view of well 410. Two liquids 705 and 710 have been dispensed sequentially in well 410. Since drop sizes may be as small as 10 μm to 100 μm, mix time is relatively short and the mixing of different liquids is almost instantaneous. Liquids 705 and 710 mix into a generally homogeneous mixture 720. Then a third liquid 715 is dispensed in well 410, as shown in FIG. 7C. Third liquid 715 mixes with mixture 720 and forms a generally homogeneous mixture 730, as shown in FIG. 7D. As will be understood by one skilled in the art, more than three liquids may be dispensed in well 410, and different dispensed liquids will form a generally homogeneous mixture in well 410 in a similar fashion. The mixing time of different liquids will depend on a multitude of factors such as the molecular structures of different liquids, the temperature of the liquids, presence of any solvents or co-solvents, ionic strengths of different liquids and the pH factors of different liquids. The mixing may be greatly enhanced by the small drop size and the layered dispensing. By way of a non-limiting example, a typical color dye in a low surface tension fluid, such as a typical inkjet ink, the mixing is almost instantaneous. However, for liquids with larger molecules, the diffusion time may be relatively longer. Even then, the mixing is comparatively faster than in case of the methods currently employed to dispense such liquids.

Figure 8A:
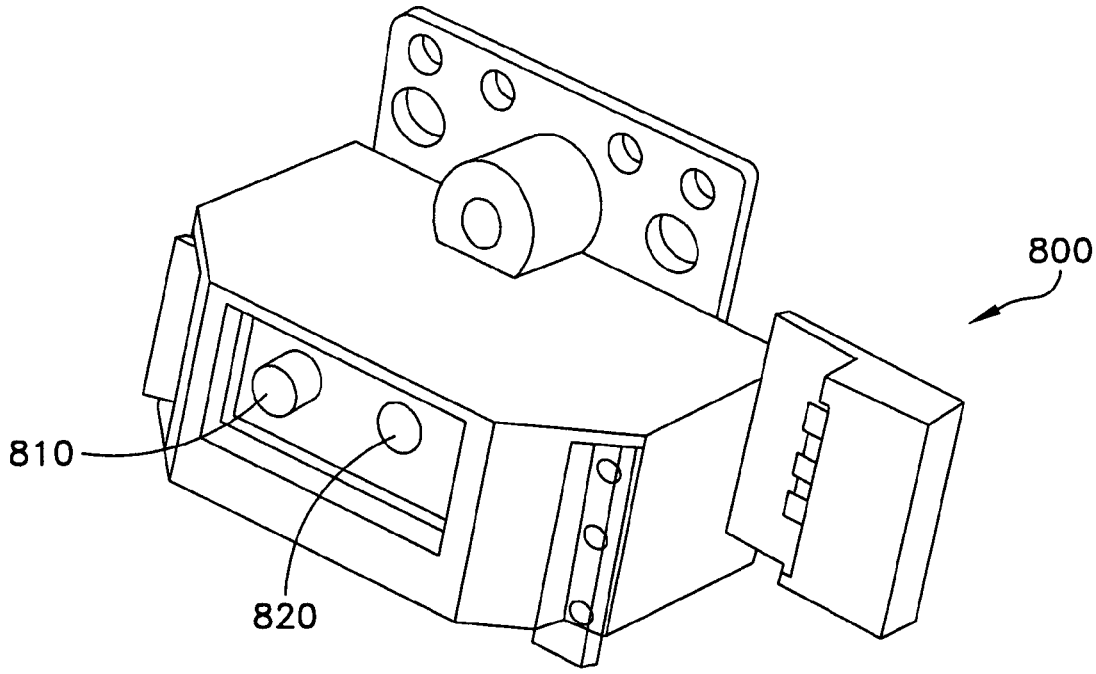
FIGS. 8A-8C illustrate an exemplary embodiment of an optical detection system which may be built into the automated liquid handling system of FIG. 2.
Figure 8B:
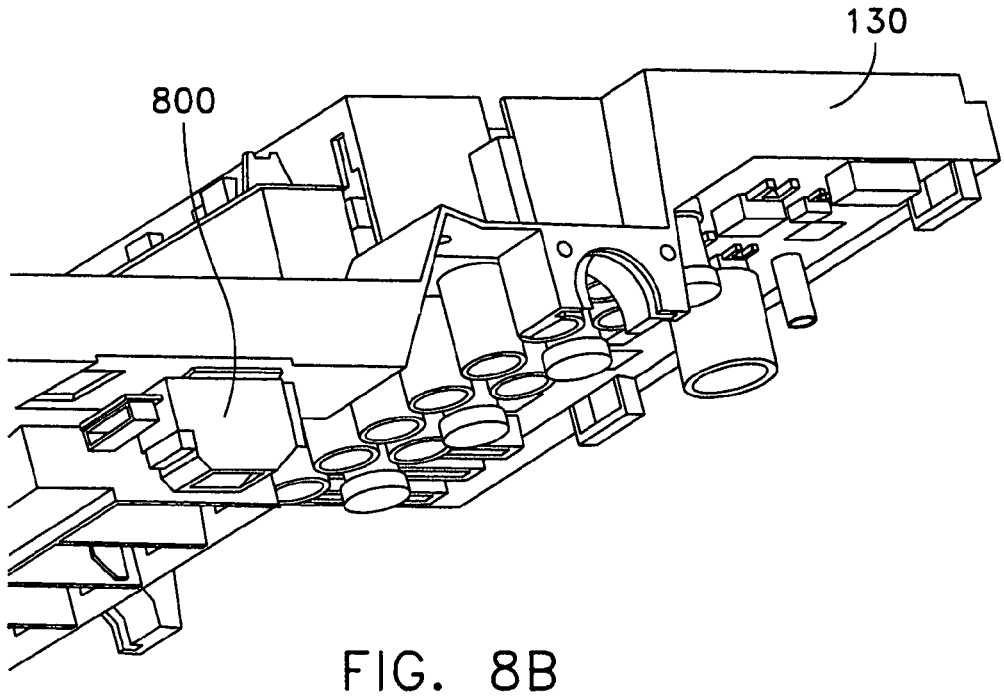
Figure 8C:
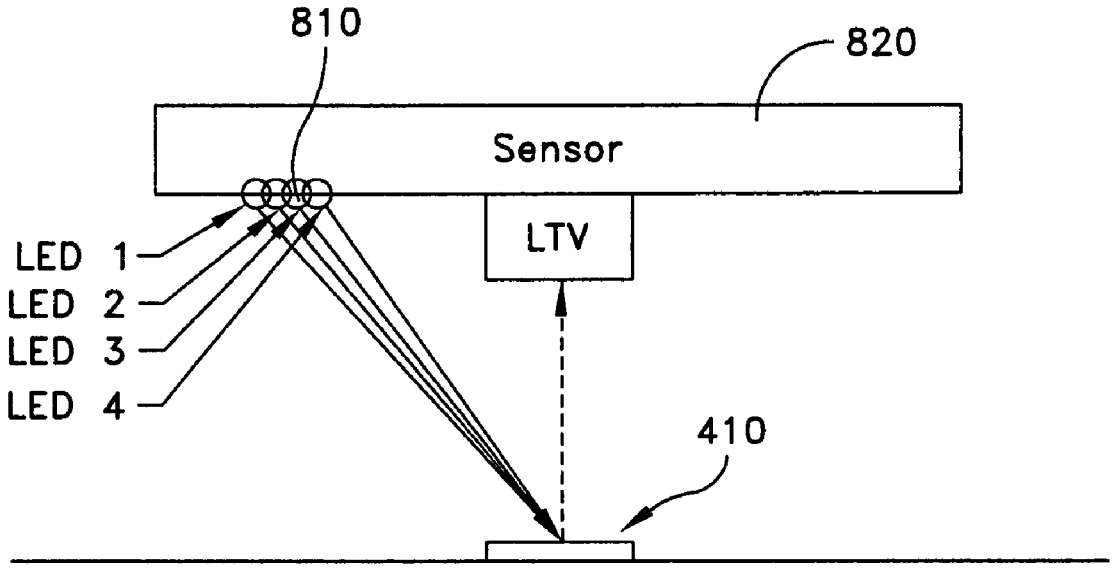

FIG. 8A illustrates an exemplary embodiment of an optical sensor 800. Optical sensor 800 includes a light source 810 and a Light to Voltage (LTV) converter 820. Light source 810 may include a multiple number of Light Emitting Diodes (LED) of different colors, in an exemplary embodiment of the present invention. As illustrated in FIG. 8B, optical sensor 800 is positioned on carriage assembly 130. Optical sensor 800 may be in close proximity of pens 115 (of FIG. 2). FIG. 8C illustrates schematically the operating principle of optical sensor 800. Light emitted by light source(s) 810 is focused on a well 410, wherein one or more liquids have been dispensed. The light reflected by the one or more liquids in well 410 is sensed by converter 820. Voltage generated by converter 820 is a function of the type of light and the type and volume of liquid(s) present in well 410. Since the type of light is known, the type and volume of liquid(s) dispensed in well 410 may be determined. Optical sensor 800 may be used after every pass of carriage assembly 130 (of FIG. 2) over well 410, or after liquid has been dispensed in the entire well plate 315 (of FIG. 3A), for example. Optical sensor 800 may also be used to measure absorbance, fluorescence and luminescence of the mixture of liquid dispensed in well 410.

Figure 9:
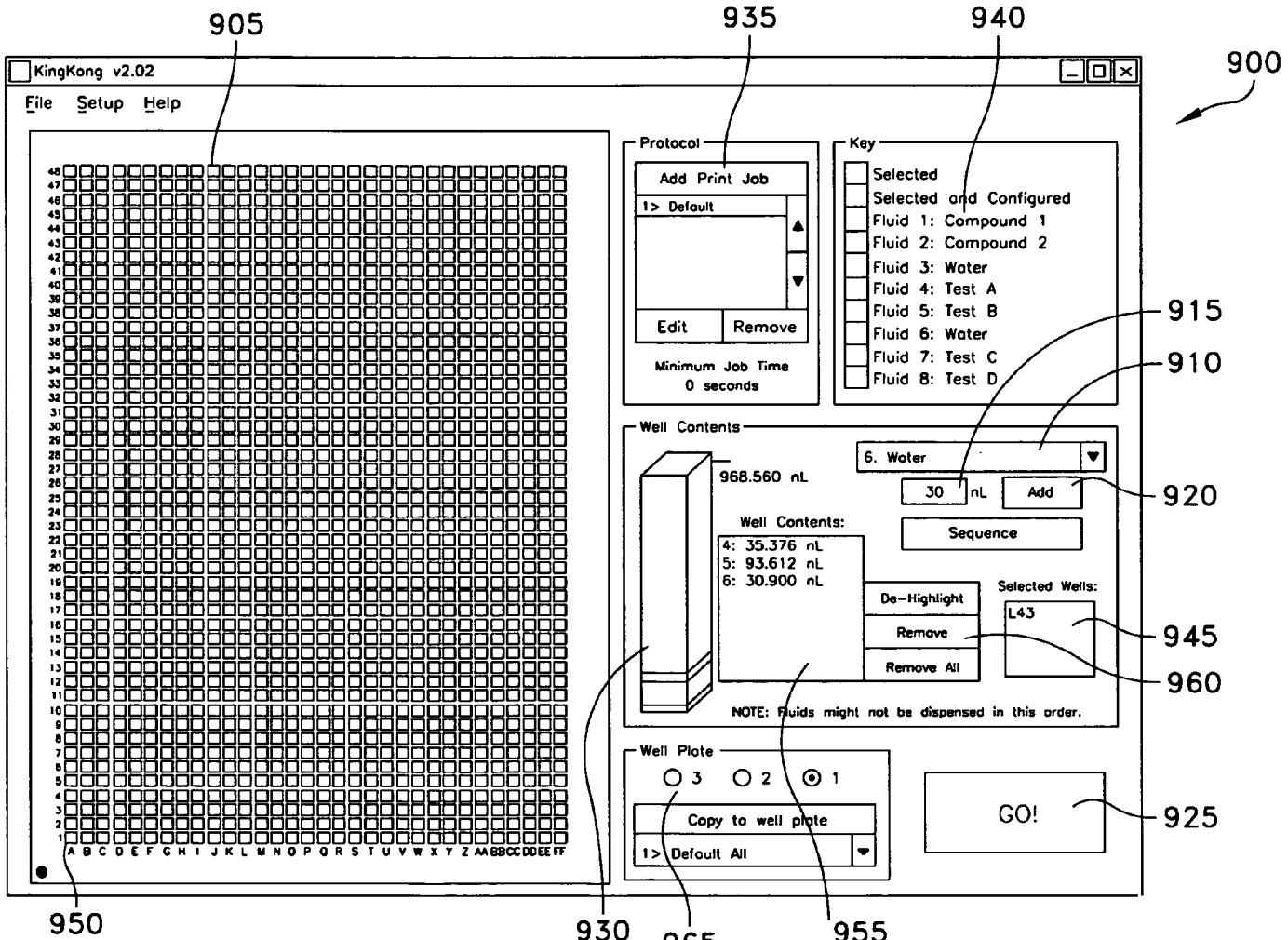
FIG. 9 illustrates an exemplary graphic user interface for dispensing liquid on a well plate, according to an embodiment of the present invention.

FIG. 9 illustrates an exemplary graphic user interface 900. Interface 900 displays the layout 905 of a well plate 400. Each well 950 of well plate 400 is graphically represented in interface 900. In an exemplary embodiment of the present invention, well 950 may be selected by clicking on layout 905 using an input device such as a mouse. Each well 950 is uniquely identified and the selected well 950 is displayed in a text box 945. Alternatively, well 950 may also be selected by typing in a unique identifier in another embodiment. Each of up to eight (8) different liquids may be graphically represented in a distinct color in a legend box 940. A liquid may be selected to be dispensed in a desired well 950 using a pull-down menu 910. The desired volume of the selected liquid to be dispensed may be input in a text box 915. Once the liquid and the desired volume are selected, button 920 may be clicked to add the selection to the list displayed in a text box 955. Each selected liquid for a given well 950 is graphically represented in display box 930 which represents the selected well 950. Text box 955 displays each of the selected liquids and their respective volumes which are to be dispensed in selected well 950. Buttons 960 may be used to select and remove a previously selected liquid for given well 950, if it is no longer desired to dispense that liquid. A given selection of liquids and their volumes to be dispensed may be saved for future use using the buttons in a box 935. Multiple numbers of well plates may be graphically represented using radio buttons 965. Clicking on button 925 will cause the liquid(s) to be dispensed onto the well plate(s) previously selected.

Figure 10:
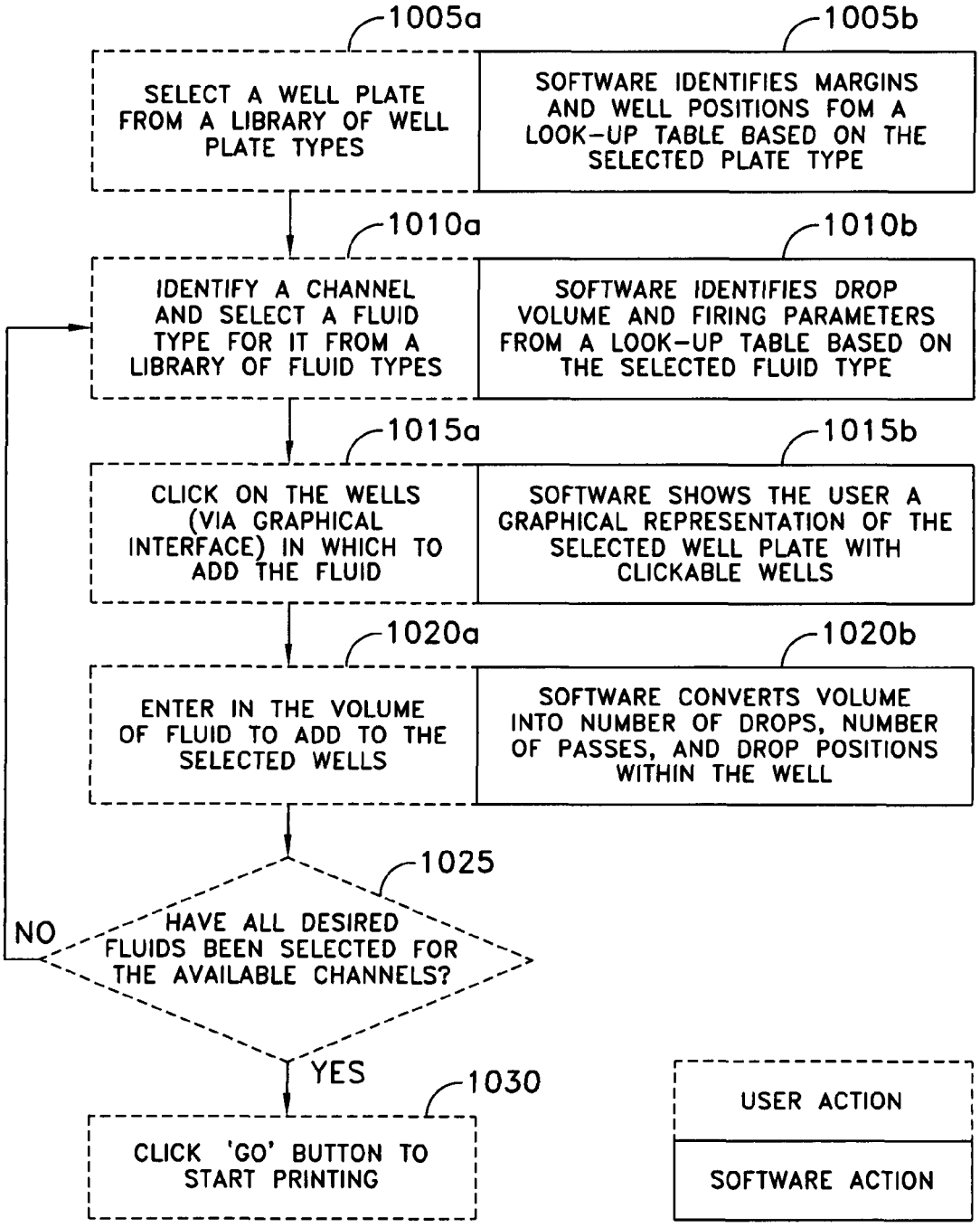
FIG. 10 illustrates a process flow diagram for selecting printing parameters for the automated liquid handling system of FIG. 2, according to an embodiment of the invention.

Referring now to FIG. 10, an exemplary process flow is illustrated. At block 1005*a*, the user selects a well plate from a library of well plate types. Responsive to the user selection, the computer code identifies margins and well positions from a look-up table, based on the selected well plate type, as at block 1005*b*. The user identifies a channel and selects a fluid type for the channel from the library of fluid types, as at block 1010*a*. At block 1010*b*, responsive to the fluid selection by the user, the computer code identifies drop volume and firing parameters from a look-up table based on the selected fluid type. The computer code causes a graphical representation of the selected well plate with selectable wells to be shown to the user, as at block 1015*b*. At block 1015*a*, the user selects the wells in which it is desired to add fluid, using the graphical interface, in an exemplary embodiment of the invention. The user inputs the volume of fluid to be dispensed to the selected wells, at block 1020*a*. Responsive to the user input, the computer code calculates the number of drops of fluids, number of passes required and the drop positions within a well to dispense the volume of fluid as desired by the user, at block 1020*b*. At block 1025, the system confirms if all desired fluids have been selected for the available channels. If all the desired fluids have not been selected, the steps depicted in blocks 1010*a*-1010*b* to blocks 1020*a*-1020*b* are repeated until all the desired fluids have been selected. At block 1030, the user issues a command to start dispensing the fluid(s) as per the selected parameters.

Figure 11A:
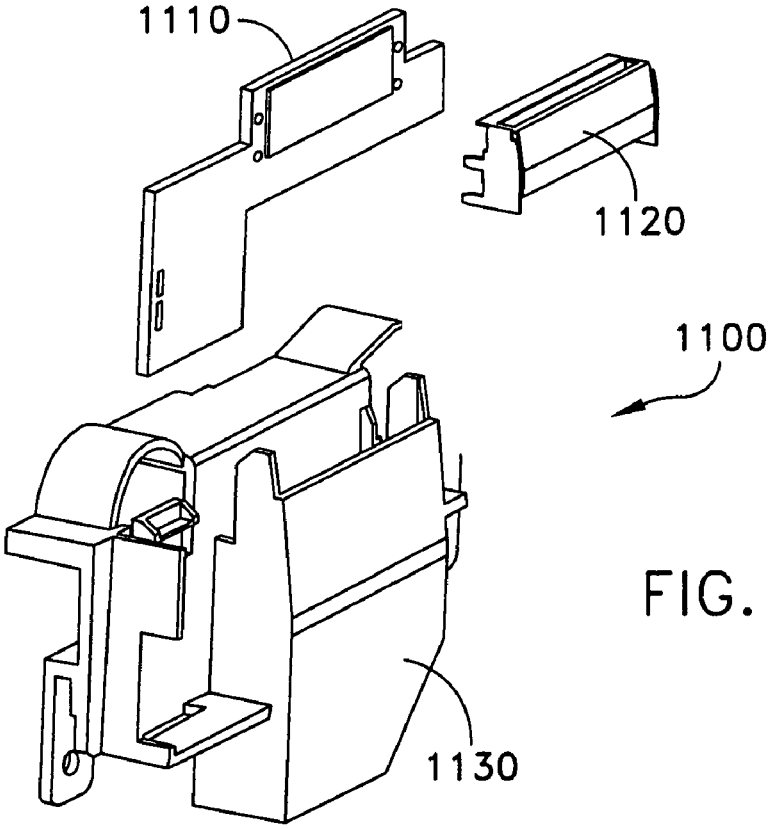
FIGS. 11A-11B illustrate an exemplary prior art drop detect system which may be incorporated in the system of FIG. 2.
Figure 11B:
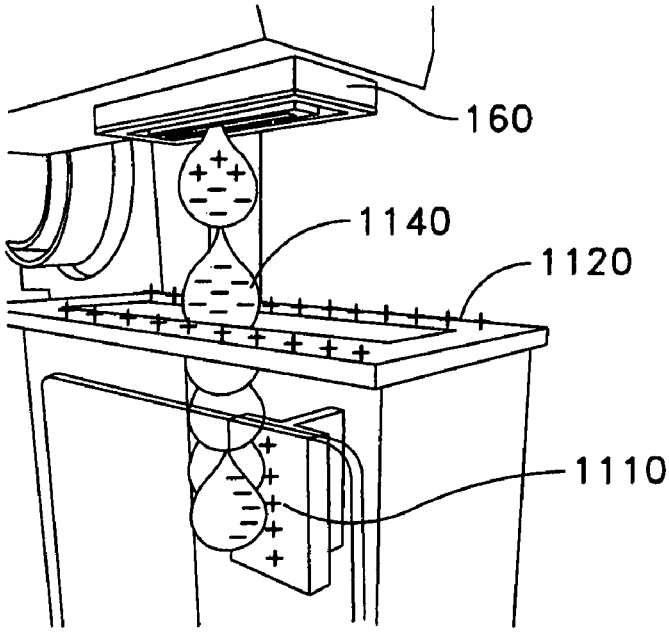

FIG. 11A illustrates an exploded perspective view of an exemplary electrostatic drop detect system 1100 for system 100 of FIG. 1. Drop detect system 1100 includes a bias plate 1120, a sensing plate 1110, and a holder 1130. Holder 1130 collects fluid drops dispensed into drop detect system 100. Referring now to FIG. 11B, a print head 160 is positioned above drop detect system 1100. A fluid drop 1140 is fired from print head 160. Fluid drop is electrostatically charged by bias plate 1120. Sensing plate 1110 detects the voltage of the charged fluid drop 1140. Based on the measured voltage of fluid drop 1140, the volume of fluid drop 1140 may be determined. Drop detect system 1100 may be used to test a nozzle 500 (of FIG. 5) of print head 160 and check whether a proper volume of fluid is fired from nozzle 500. If no fluid drop 1140 is detected, or if volume of fluid drop 1140 varies from the desired volume, nozzle 500 may be clogged or malfunctioning. In such a case, other functioning nozzles may be used to dispense the desired volume of fluid. Since system 100 (of FIG. 1) may have hundreds of nozzles 500 for a single fluid, the impact of any clogged or malfunctioning nozzles would be minimal, as other properly functioning nozzles may be used to dispense the required amount of liquid. In an exemplary embodiment of the present invention, all print heads 160 may be tested using drop detect system 1100 either before the dispensing of liquids is undertaken or periodically in between passes over substrate 102 (of FIG. 1).

Figure 12A:
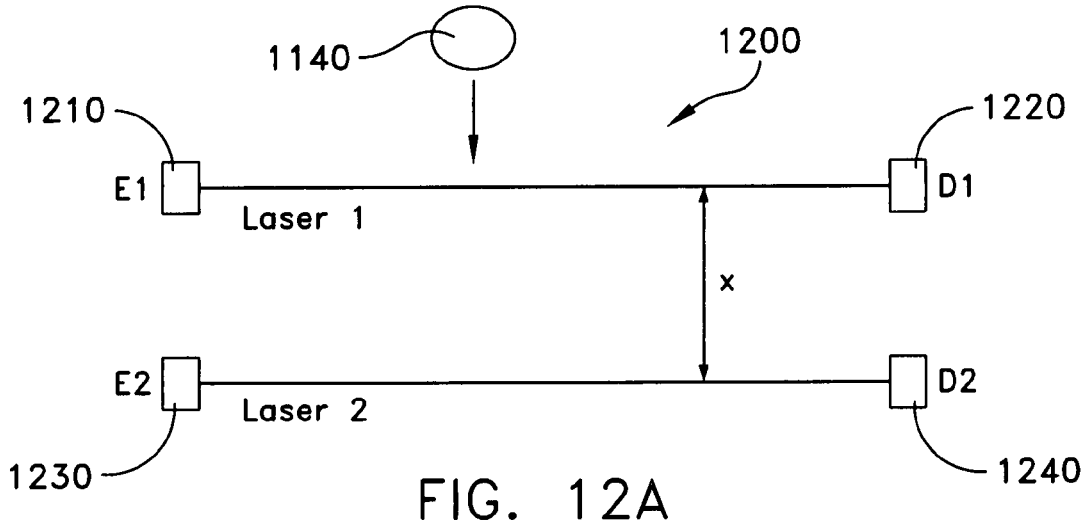
FIGS. 12A-12G illustrate another exemplary drop detect system, namely a laser system, which may be incorporated in a system of FIG. 2, according to an embodiment of the present invention.
Figure 12B:
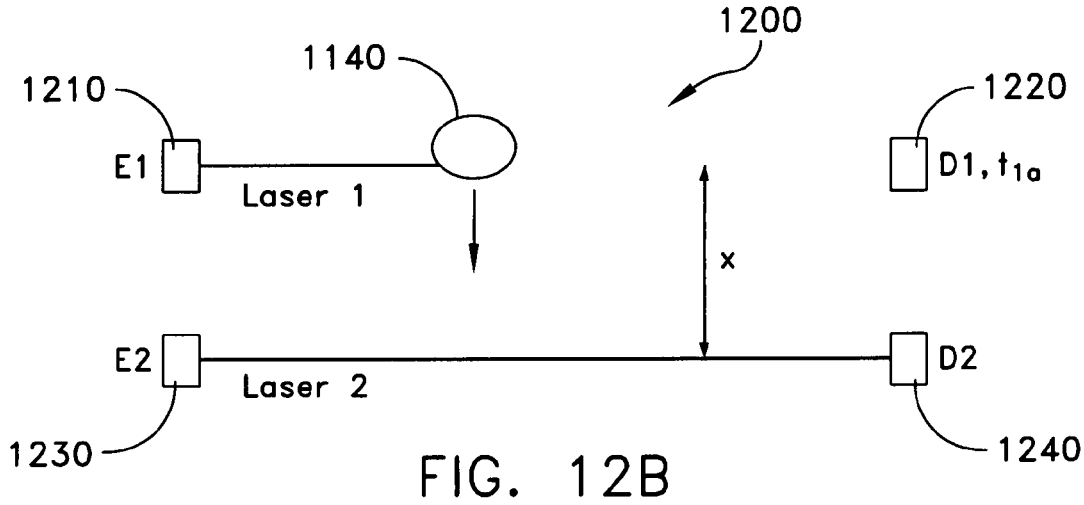
Figure 12C:
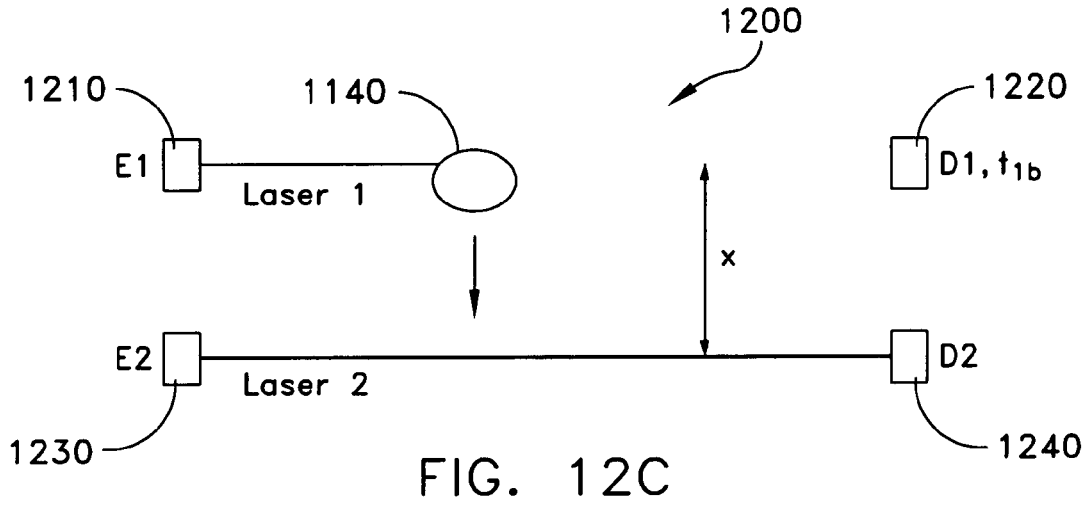
Figure 12D:
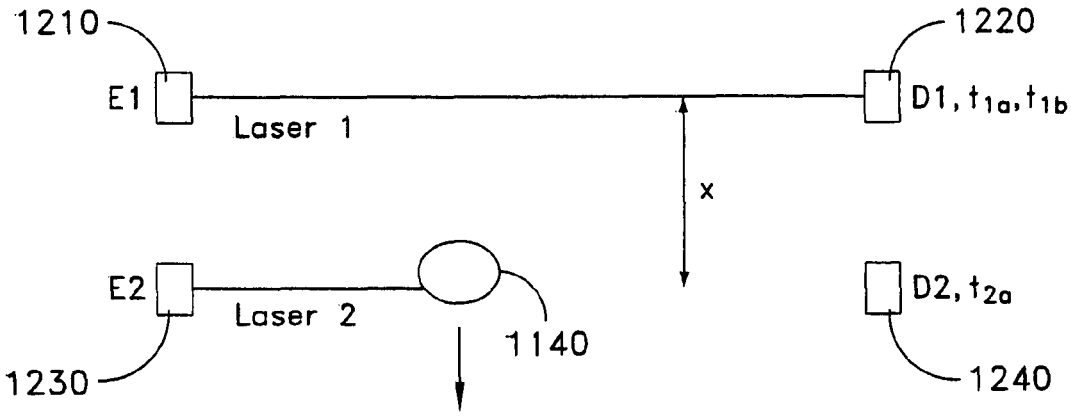
Figure 12E:
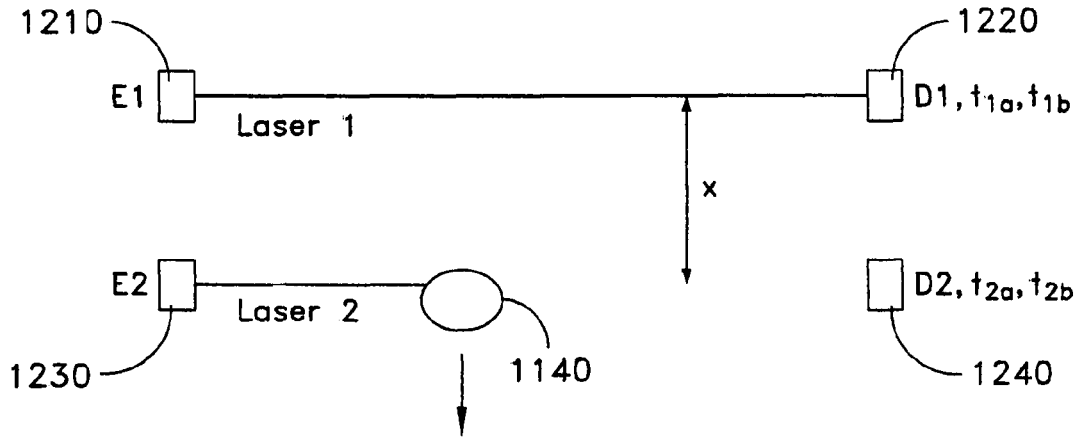
Figure 12F:
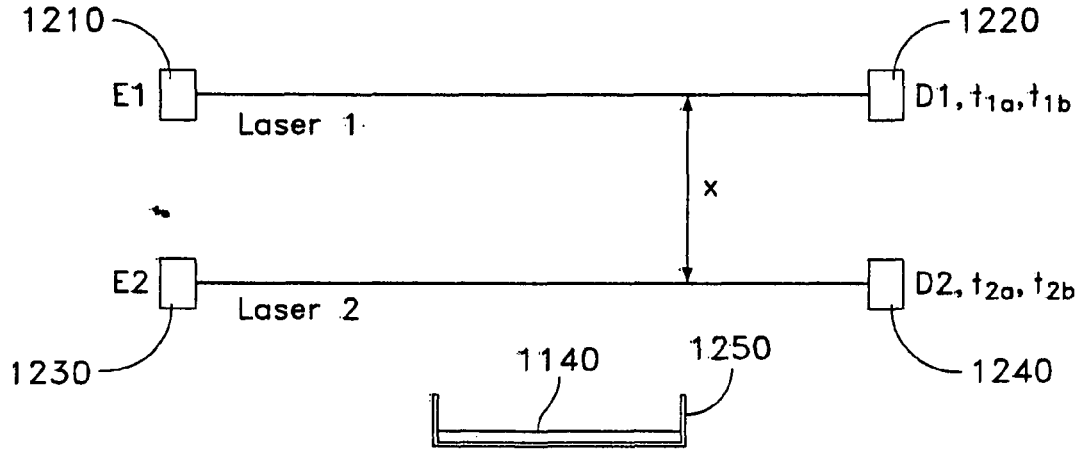

FIGS. 12A-12F illustrate an exemplary embodiment of a laser system 1200, which may be incorporated in liquid handling system 100 of FIG. 2. Laser system 1200 includes two laser emitters 1210 and 1230 and two laser detectors 1220 and 1240. Laser beam emitted by emitter 1210 is detected by detector 1220 and laser beam emitted by emitter 1230 is detected by detector 1240. The first pair of emitter 1210 and detector 1220 is separated from the second pair of emitter 1230 and detector 1240 by a predetermined distance x. FIG. 12A shows a drop 1140 (of FIG. 11) fired by a print head 160 (of FIG. 1). Drop 1140 has not yet intercepted either of the laser beams emitted by emitters 1210 and 1230. In FIG. 12B, drop 1140 has just intercepted the laser beam emitted by emitter 1210. The time $t_{1a}$ when drop 1140 has just intercepted the laser beam is recorded. In FIG. 12C, drop 1140 is about to leave the pathway of laser beam emitted by emitter 1210. The time $t_{1b}$ is recorded when detector 1220 detects the laser beam emitted by emitter 1210. Referring now to FIG. 12D, drop 1140 has just intercepted the laser beam emitted by emitter 1230. The time $t_{2a}$ is recorded when drop 1140 has just intercepted the laser beam emitted by emitter 1230. In FIG. 12E, drop 1140 is about to leave the pathway of laser beam emitted by emitter 1230. Time $t_{2b}$ is recorded when detector 1240 detects the laser beam emitted by emitter 1230. In FIG. 12F, drop 1140 is collected in a gutter 1250, and both detectors 1220 and 1240 detect the laser beams emitted by emitters 1210 and 1230 respectively.

Since the predetermined distance x between the two pairs of emitter-detectors is known and the time taken by drop 1140 to travel the distance between the two pairs of emitter-detector is known, the velocity of drop 1140 can be calculated as follows:

$$\text{Drop Velocity}=x/(t_{2a}-t_{1a})$$

Figure 12G:
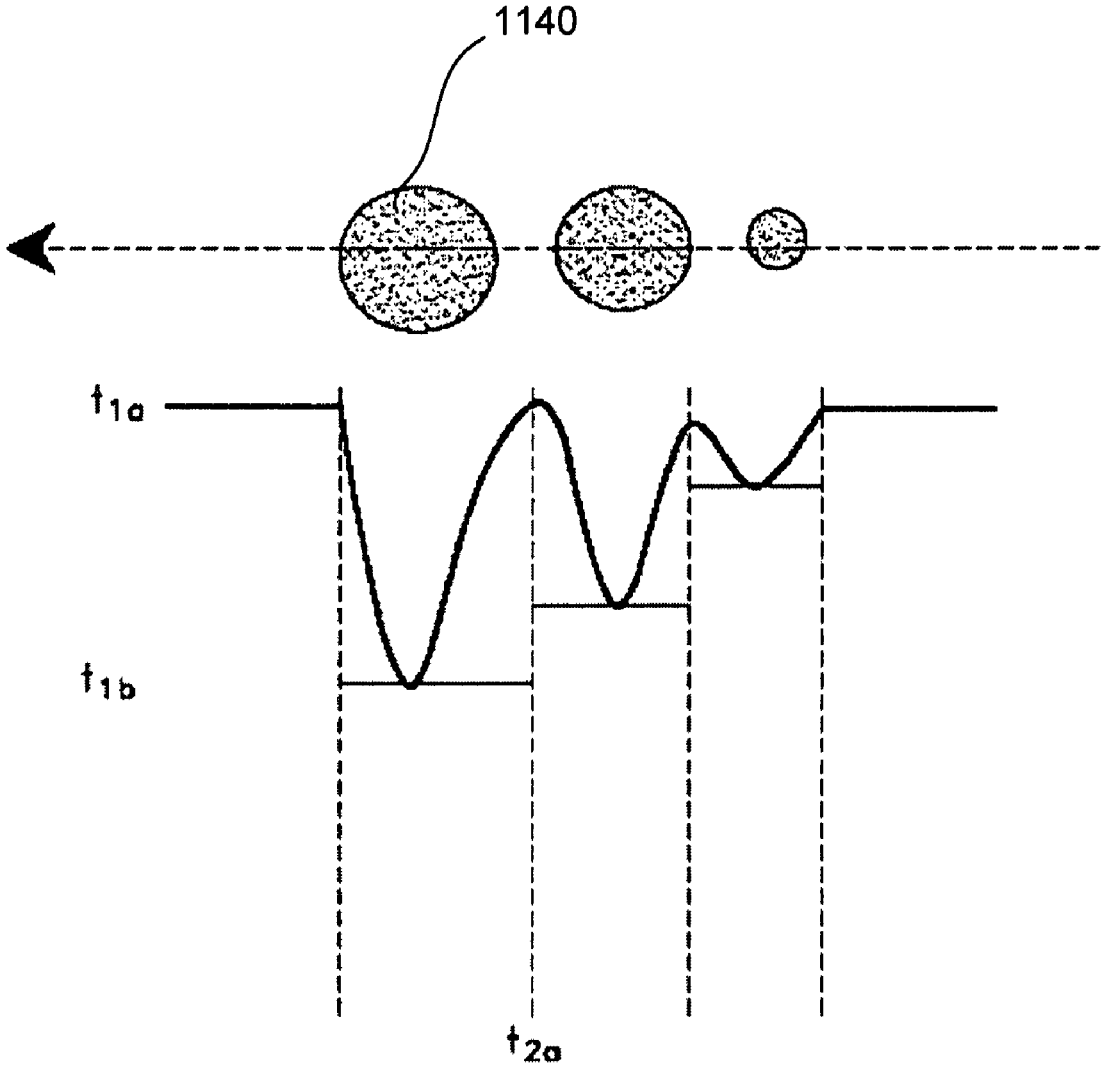

As shown in FIG. 12G, the time interval between $t_{1a}$ and $t_{1b}$ may be used to deduce the drop volume. Time interval ($t_{1a}-t_{1b}$) indicates the time taken by drop 1140 to pass through a distance approximately equal to the diameter of drop 1140. Since the time interval ($t_{1a}-t_{1b}$) is known and the drop velocity can be calculated as above, the distance can be calculated. The volume of drop 1140 may be determined from the diameter of drop 1140, and if the density of the liquid is known, drop weight of drop 1140 may also be determined. Correspondingly smaller volumes of the two illustrated satellite drops may also be calculated.

An exemplary application of liquid handling system 100 is to precisely dispense liquids for chemical reaction tests, for example, in preparing mix-and-measure assays. By lowering the total volume of chemical reagents and living cells used in such assays, the cost may be decreased. Systems are known in the art to dispense liquids in volumes as large as 300 μL to as small as 2-10 μL. Since liquid handling system 100 is capable of dispensing liquid in form of drops as small as 5 pL to 200 pL, the assay volumes may be reduced from microliters to nanoliters without compromising on precision. Although dispense times are highly application-dependent, in an exemplary embodiment, a combination of up to eight (8) liquids may be dispensed in six (6) well plates having 1536 wells in approximately one (1) minute. Since pen 115 (of FIG. 1) may store up to twenty (20) mL of a fluid, numerous assays may be prepared before pen 115 needs to be replaced or refilled, thus cutting down assay preparation time.

It is noted that, although specific embodiments have been illustrated and described herein, it will be appreciated by those of ordinary skill in the art that any arrangement calculated to achieve the same purpose may be substituted for the specific embodiments shown. This application is thus intended to cover adaptations or variations of the disclosed embodiments of the present invention. Therefore, it is intended that this invention be limited only by the claims and equivalents thereof.

We claim:

1. An inkjet printer apparatus adapted for dispensing liquid, said printer apparatus comprising:

a plurality of pens, at least one of said plurality of pens containing at least one liquid;

an inkjet print head, said print head in fluid communication with said plurality of pens;

a carrier board, said carrier board configured to hold a substrate; and a memory, said memory storing:

a look-up table for margins and well positions for the substrate;

a look-up table for drop parameters and firing parameters for each of said at least one liquid;

a code for generating a graphical representation of the substrate; and a code for determining number of drops, number of passes of said print head, and drop positions on the substrate responsive to an input specification of a volume of at least one said liquid.

2. A method for dispensing liquid, said method comprising the steps of:

providing the inkjet printer apparatus of claim 1;

storing one or more liquids in said at least one pen;

providing said substrate having at least one well; and dispensing at least one of said one or more liquids through said inkjet print head into said at least one well, wherein a volume of said dispensed liquid in said dispensing step is a fraction of a total required volume of said liquid in said at least one well, and repeating the dispensing step multiple times to obtain the total required volume of said at least one liquid in said at least one well.

3. The method of claim 2, further comprising the step of detecting drop velocity of said volume of said dispensed liquid, wherein time taken by said volume to travel between two predetermined points is measured.

4. The method of claim 2, further comprising the step of optically sensing said dispensed liquid in said at least one well, wherein fluorescence of said dispensed liquid is measured.

5. The method of claim 4, wherein fluorescence of said dispensed liquid is measured for only one well of said well-plate.

6. The method of claim 4, wherein fluorescence of said dispensed liquid is measured for all wells of said well-plate.

7. The method of claim 2, further comprising the step of optically sensing said dispensed liquid in said at least one well, wherein absorbance of said dispensed liquid is measured.

8. The method of claim 2, further comprising the step of optically sensing said dispensed liquid in said at least one well, wherein luminescence of said dispensed liquid is measured.

9. The method of claim 2 further comprising the step of isolating said inkjet print head and said well plate from the atmosphere.

10. The method of claim 2, wherein a drop of said dispensed liquid is electrostatically charged and wherein said charge is measured to determine the volume of said drop.

11. The printer apparatus of claim 1, further comprising an optical sensor for in situ measurement of fluorescence of a volume of a dispensed liquid.

12. The printer apparatus of claim 1, further comprising an optical sensor for in situ measurement of absorbance of a volume of a dispensed liquid.

13. The printer apparatus of claim 1, further comprising an optical sensor for in situ measurement of luminescence of a volume of a dispensed liquid.

14. The printer apparatus of claim 1, further comprising an environmental chamber, said chamber enveloping said apparatus.

15. The printer apparatus of claim 1, further comprising a laser system, said laser system comprising:

a first pair of a laser emitter and a laser detector; and a second pair of a laser emitter and a laser detector, wherein said first and second pairs are separated by a predetermined distance, and time taken a drop of a dispensed liquid to travel from said first pair to said second pair is measured to determine the velocity of said drop.

16. The printer apparatus of claim 1, further comprising an electrostatic drop detect system, said drop detect system comprising:

a bias plate;

a sensing plate; and a holder, said holder collecting a liquid dispensed from said thermal inkjet print head.

17. The printer apparatus of claim 1 wherein said inkjet printer head comprises a thermal inkjet print head.

* * * * *